US007444951B2

(12) United States Patent
Ishikawa et al.

(10) Patent No.: US 7,444,951 B2
(45) Date of Patent: Nov. 4, 2008

(54) CURVED EDGE SEWING SYSTEMS

(75) Inventors: Kiichiro Ishikawa, Toyama (JP); Chet P. Dudek, Marietta, GA (US)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/602,538

(22) Filed: Nov. 21, 2006

(65) Prior Publication Data

US 2008/0115710 A1 May 22, 2008

(51) Int. Cl.
*D05B 27/18* (2006.01)
*D05B 27/10* (2006.01)

(52) U.S. Cl. ..... 112/475.04; 112/470.33; 112/308

(58) Field of Classification Search ..... 112/309, 112/407.04, 475.06, 475.09, 470.33, 308
See application file for complete search history.

(56) References Cited

U.S. PATENT DOCUMENTS

| | | | | |
|---|---|---|---|---|
| 1,864,453 | A | 6/1932 | Lutz | |
| 3,650,229 | A | 3/1972 | Rovin | |
| 3,722,441 | A * | 3/1973 | Kitchener et al. | 112/309 |
| 4,019,447 | A | 4/1977 | Blessing et al. | |
| 4,498,404 | A * | 2/1985 | Sadeh | 112/470.04 |
| 4,593,636 | A | 6/1986 | Schips | |
| 4,685,408 | A * | 8/1987 | Frye | 112/475.06 |
| 4,730,824 | A | 3/1988 | Huau et al. | |
| 5,069,148 | A | 12/1991 | Ishikawa et al. | |
| 5,131,339 | A * | 7/1992 | Goodridge | 112/475.05 |
| 5,161,474 | A | 11/1992 | Ishikawa et al. | |
| 5,170,733 | A | 12/1992 | Honma et al. | |
| 5,497,720 | A | 3/1996 | Kawasaki | |
| 5,647,292 | A | 7/1997 | Morgulis et al. | |
| 6,237,518 | B1 * | 5/2001 | Yunoki et al. | 112/470.33 |
| 2007/0017425 | A1 | 1/2007 | Sho | |

* cited by examiner

*Primary Examiner*—Ismael Izaguirre
(74) *Attorney, Agent, or Firm*—Alston & Bird LLP

(57) ABSTRACT

A curved edge sewing system sews a curved edge of a cloth, such as a curved edge of a fly. The curved edge sewing system has a cloth support table, and a sewing needle located at a sewing position relative to the cloth support table. A cloth presser device moves towards and away from the cloth support table and rotates relative to the sewing needle. A first driver is operatively connected to the cloth presser device and moves the cloth presser device towards and away from the cloth support table. A second driver is operatively connected to the cloth presser device and rotates the cloth presser device relative to the sewing needle. A controller has a first signal supplied to the first driver and actuates the first driver, and a second signal supplied to the second driver and actuates the second driver.

17 Claims, 8 Drawing Sheets

CURVED EDGE SEWING SYSTEMS

BACKGROUND OF THE INVENTION

The present invention generally pertains to sewing systems. More specifically, the present invention pertains to sewing systems which sew a curved edge on a cloth piece. In embodiments, the curved edge sewing systems sew a curved edge of a fly. The present invention also pertains to methods of sewing curved edges on flies or other cloth pieces.

Pieces of cloth, such as a fly for pants, have been sewed along a curved edge. The fly typically has a rectangular strip-like shape with one corner cut in a circular arc shape. An edge of the fly including the edge of the circular arc is sewed. Existing sewing of the fly is accomplished by a sewing operator manually rotating the strip-like fly relative to a sewing needle as the edge is sewed. The manual operation of rotating the strip-like fly is subject to variability depending on differences in technique and ability of the sewing operators. The quality and consistency of the curved sewed edge can vary and may not be acceptable. Also, the operator must have a relatively high level of skill to manually rotate the curved edge for sewing.

An edge sewing apparatus for sewing an edge of a cloth piece in a strip-like shape, such as a fly, along one side edge thereof in a curved shape is disclosed in U.S. patent application Ser. No. 11/482,457, filed Jul. 7, 2006. The edge sewing apparatus provides edge sewing in a curved shape along one side edge of a cloth piece in a strip-like shape while rotating the cloth piece. The edge sewing apparatus includes a press rotating member rotated in accordance with feeding of the cloth piece while pressing the cloth piece, a rotational angle measuring device that measures a rotational angle of the press rotating member, and a press releasing device that releases the press rotating member from being pressed when the rotational angle measured by the rotational angle measuring device reaches a predetermined angle. A cloth feeding mechanism at the sewing needle feeds the cloth piece passed the sewing needle. When the cloth piece is held by the press rotating member, the cloth feeding mechanism rotates the cloth piece which results in the rotation of the press rotating member. The press rotating member is free to rotate, and rotates due to the cloth being fed by the cloth feeding mechanism. The press rotating member does not drive the rotation of the cloth piece. Accordingly, the edge sewing apparatus does not have a mechanism which drives the press rotating member to drive rotation of the cloth piece. The edge sewing apparatus utilizes the cloth feeding mechanism to rotate the cloth piece which can result in inconsistent rotation and inconsistent edge sewing of the cloth piece. Also, the operator has to manually assist the rotation of the cloth piece which can also result in inconsistencies in rotation of the cloth piece and edge sewing. The quality of the sewed curved edge may be degraded due to the inconsistency and manual assistance by the operator.

Accordingly, needs exist to improve curved edge sewing systems for the reasons mentioned above and for other reasons.

SUMMARY OF THE INVENTION

The present invention provides new curved edge sewing systems and methods. The present invention is described in an embodiment of a curved edge sewing system for sewing the edge of a curved fly. However, the present invention is broader than sewing curved flies and is not limited to sewing curved flies. The curved edge sewing system automatically rotates the curved fly relative to a sewing needle and sews the curved edge of the fly.

Examples of curved flies that can be sewn by the curved edge sewing system include flies for jeans and casual pants. Of course, the curved edge sewing system can sew other types of flies, as well. The curved edge sewing systems are suitable for use with a wide range of materials, including types of cloths, types of materials, thicknesses and sizes.

In an embodiment of the present invention, a curved edge sewing system for sewing a curved edge of a cloth has a cloth support table, a sewing needle located at a sewing position relative to the cloth support table, and a cloth presser device movable towards and away from the cloth support table and rotatable relative to the sewing needle. A first driver is operatively connected to the cloth presser device and moves the cloth presser device towards and away from the cloth support table. A second driver is operatively connected to the cloth presser device and rotates the cloth presser device relative to the sewing needle. A controller has a first signal supplied to the first driver which actuates the first driver, and a second signal supplied to the second driver which actuates the second driver.

During use of the curved edge sewing system, the cloth presser device holds the cloth against the cloth support table in response to the first signal of the controller, and the cloth presser device rotates the cloth relative to the sewing needle in response to the second signal of the controller.

The second signal causes the cloth presser device to rotate the cloth relative to the sewing needle through a specified angle. The specified angle can be about 90°.

The second driver may be a pair of linear air cylinders.

In an embodiment of the present invention, a device for positioning a cloth article to be sewed during sewing has a cloth article holder. A first driver is operatively connected to the cloth article holder and moves the cloth article holder into and out of a cloth article holding position. A second driver is operatively connected to the cloth article holder and rotates the cloth article holder when the cloth article holder is in the cloth article holding position. A controller has a first signal supplied to the first driver which actuates the first driver, and a second signal supplied to the second driver which actuates the second driver.

During use of the device for positioning a cloth article to be sewed, the cloth article holder rotates the cloth article to be sewed in response to the second signal of the controller.

The second signal causes the cloth article holder to rotate the cloth article to be sewed through a specified angle. The specified angle can be about 90°.

The second driver can be a pair of linear air cylinders.

In an embodiment of the present invention, a method of sewing a curved edge of a cloth provides positioning a cloth on a support table, pressing the cloth against the cloth table with a cloth presser device in response to a first signal from a controller, rotating the cloth presser device in response to a second signal from the controller, rotating the cloth by the rotation of the cloth presser device, and sewing the cloth along a curved edge during the rotation of the cloth.

The rotating steps may rotate the cloth through a specified angle. The specified angle can be about 90°.

The rotating of the cloth presser device step may include actuating a linear air cylinder linked to the cloth presser device.

Embodiments of the present invention may have various features and provide various advantages. Any of the features and advantages of the present invention may be desired, but, are not necessarily required to practice the present invention.

One advantage of the present invention can be to provide new curved edge sewing systems.

Another advantage of the present invention can be to provide curved edge sewing systems for sewing the edge of a cloth, for example a curved fly.

Another advantage of the present invention can be to provide curved edge sewing systems that positively rotate a cloth during sewing of a curved edge.

A further advantage of the present invention can be to provide curved edge sewing systems which rotate a cloth through a desired angle, for example 90°, during edge sewing.

Yet another advantage of the present invention can be to improve quality and consistency of sewed curved edges.

A further advantage of the present invention can be to reduce or eliminate manual sewing of a curved edge of a cloth. Also, an advantage can be to reduce the level of operator skill needed to sew a curved edge.

Yet another advantage of the present invention can be to provide improved sewing systems.

Other advantages may include providing new methods of sewing a cloth having a curved edge.

Additional features and advantages of the present invention are described in, and will be apparent from, the following Detailed Description of the Invention and the figures. The features and advantages may be desired, but, are not necessarily required to practice the present invention.

DETAILED DESCRIPTION OF THE INVENTION

Figure 1:
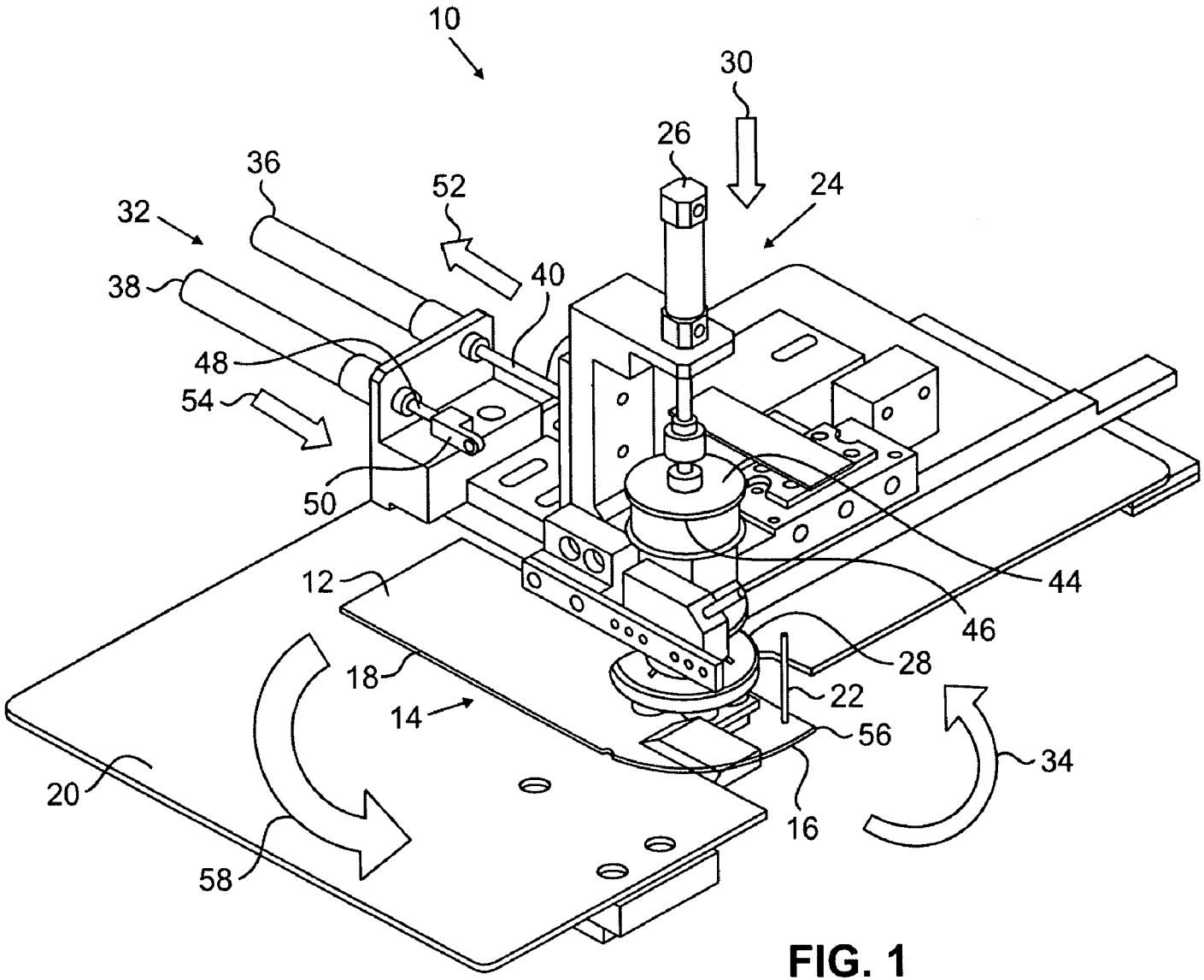
FIG. 1 is a perspective view of a curved edge sewing system according to the present invention.
Figure 2:
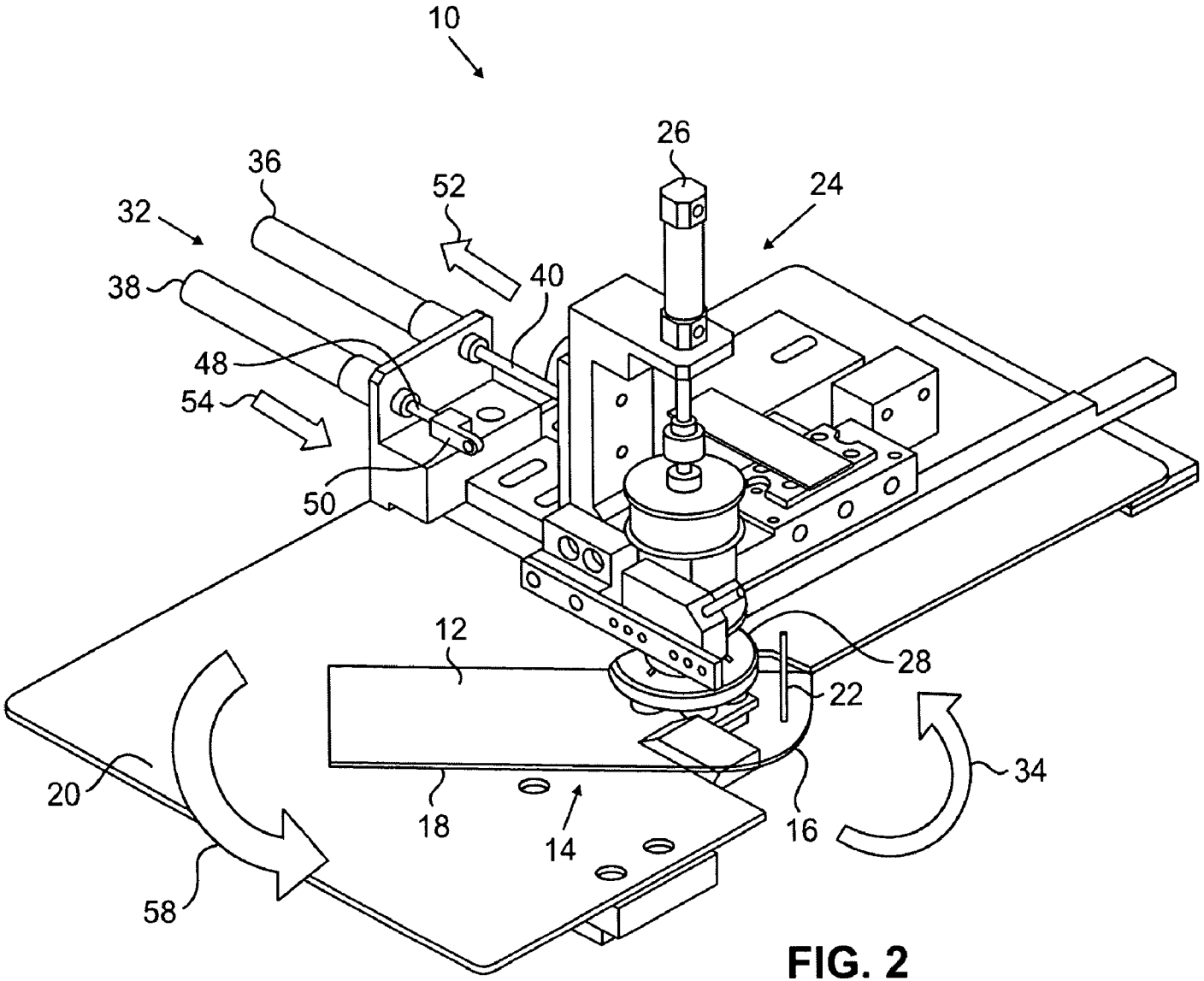
FIG. 2 is another perspective view of the curved edge sewing system.
Figure 3:
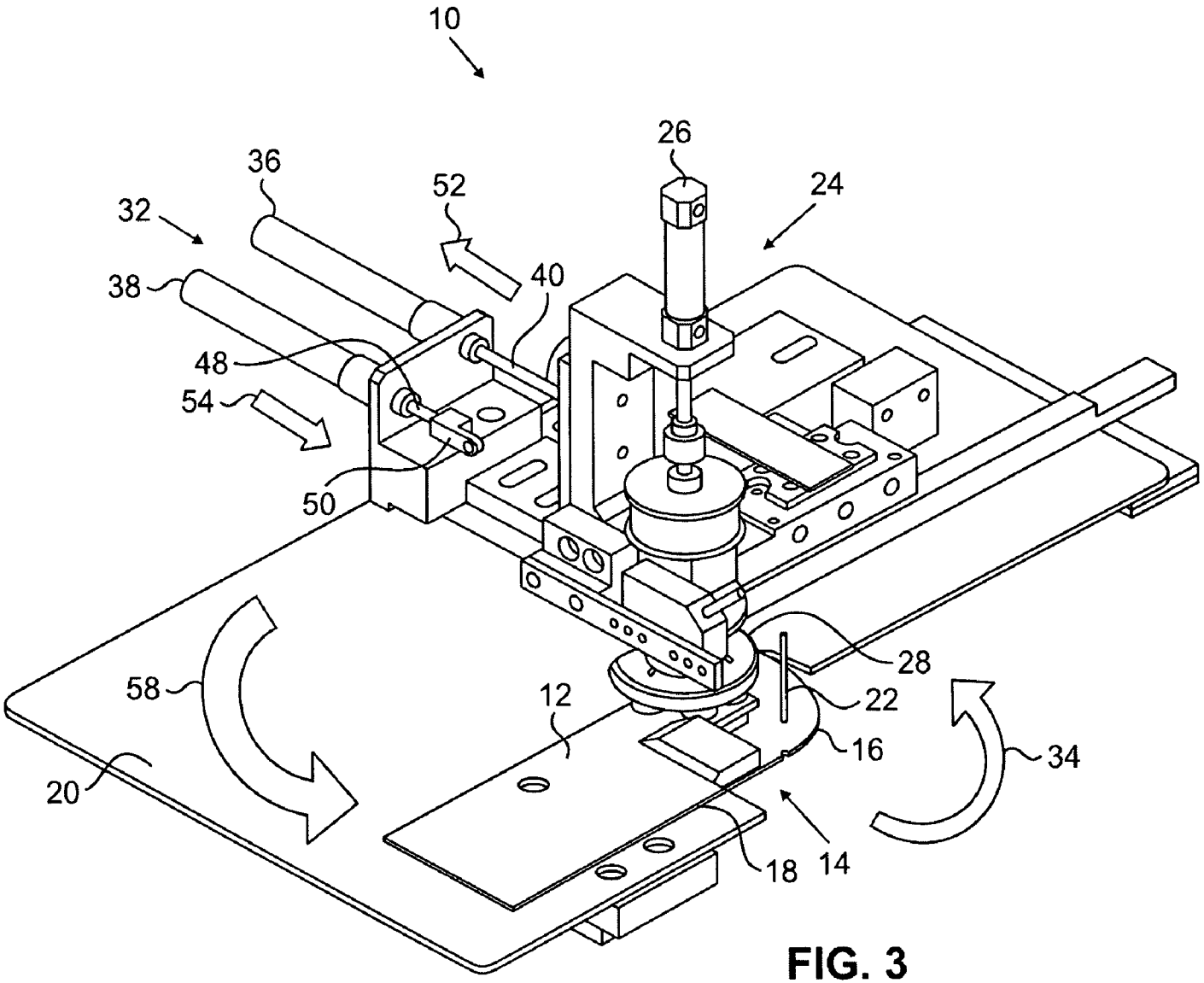
FIG. 3 is another perspective view of the curved edge sewing system.
Figure 4:
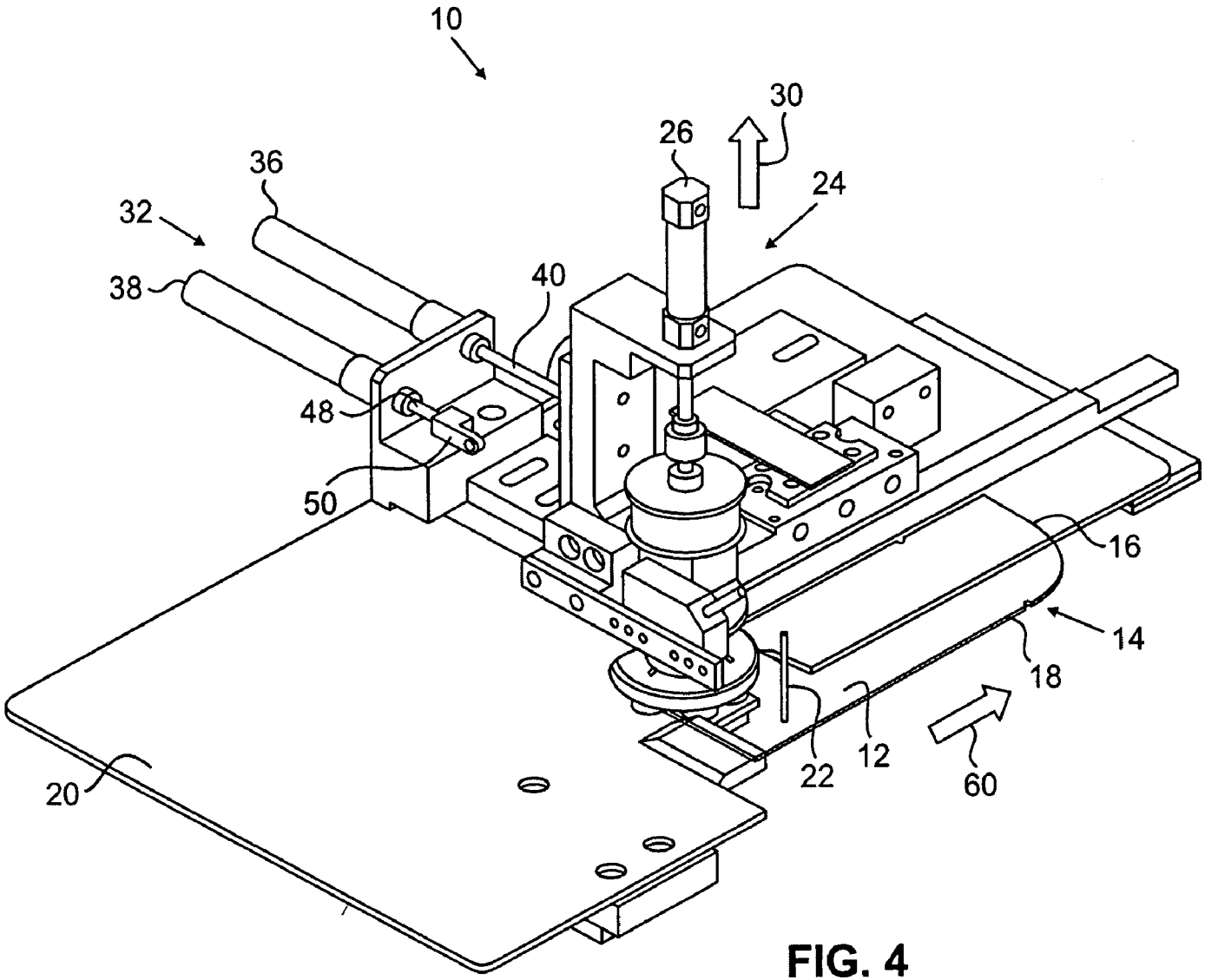
FIG. 4 is another perspective view of the curved edge sewing system.
Figure 5:
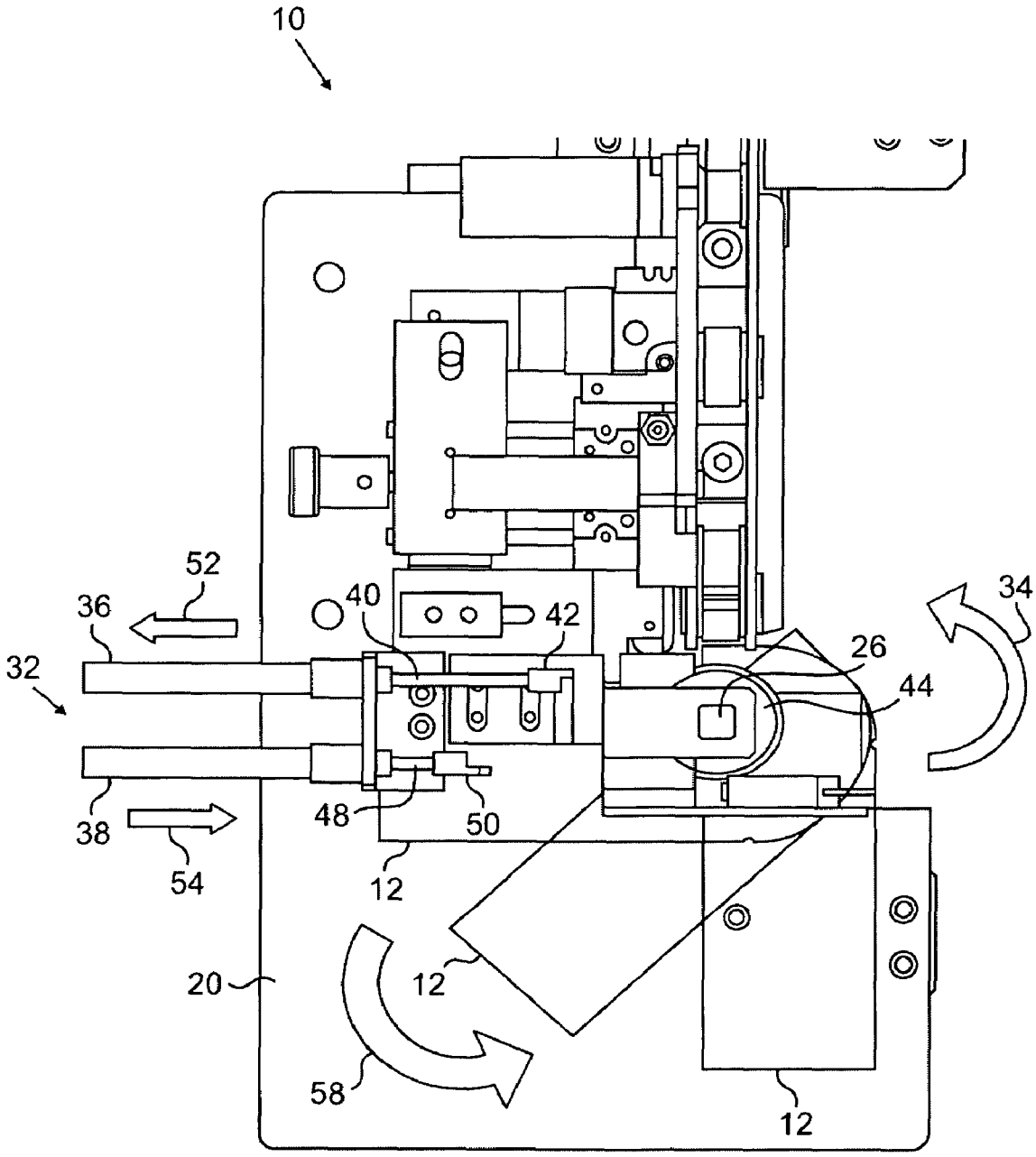
FIG. 5 is a top view of the curved edge sewing system.
Figure 6:
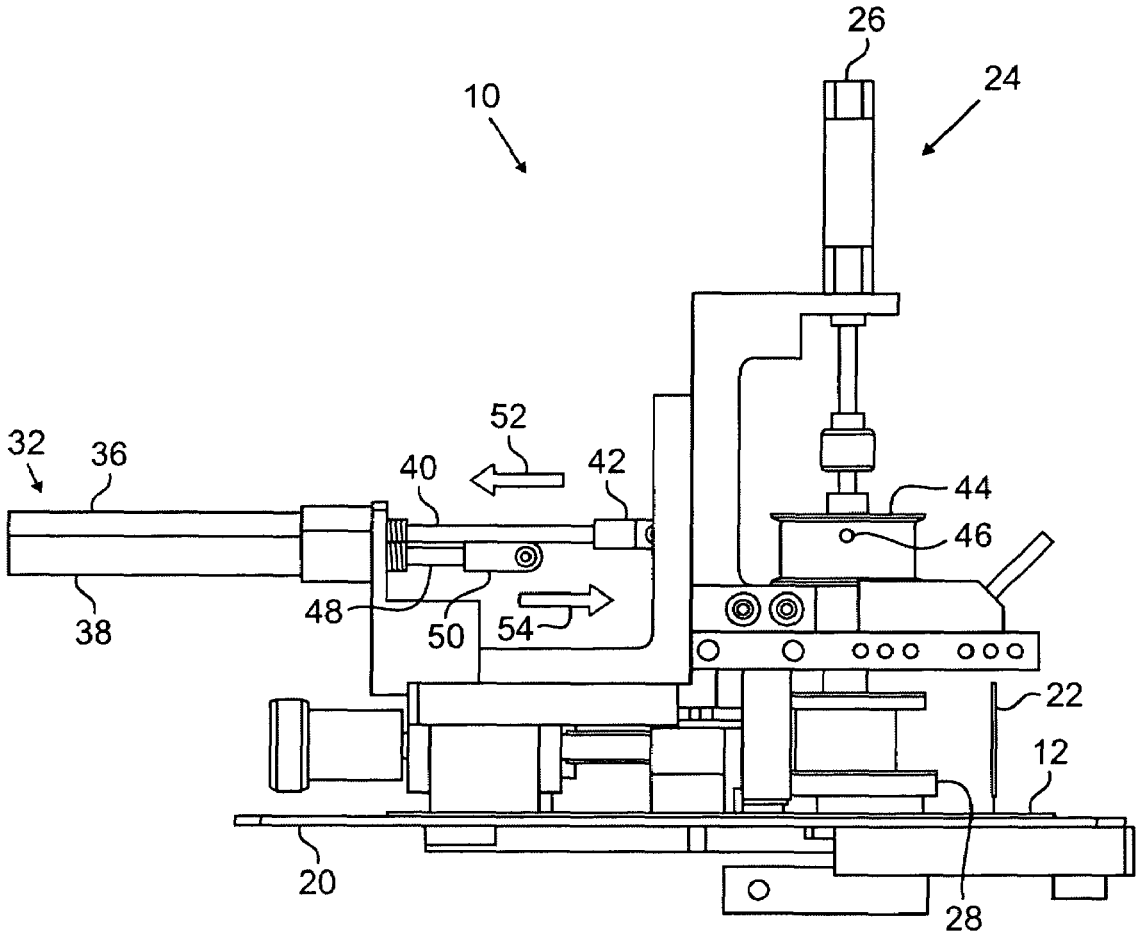
FIG. 6 is a front view of the curved edge sewing system.
Figure 7:
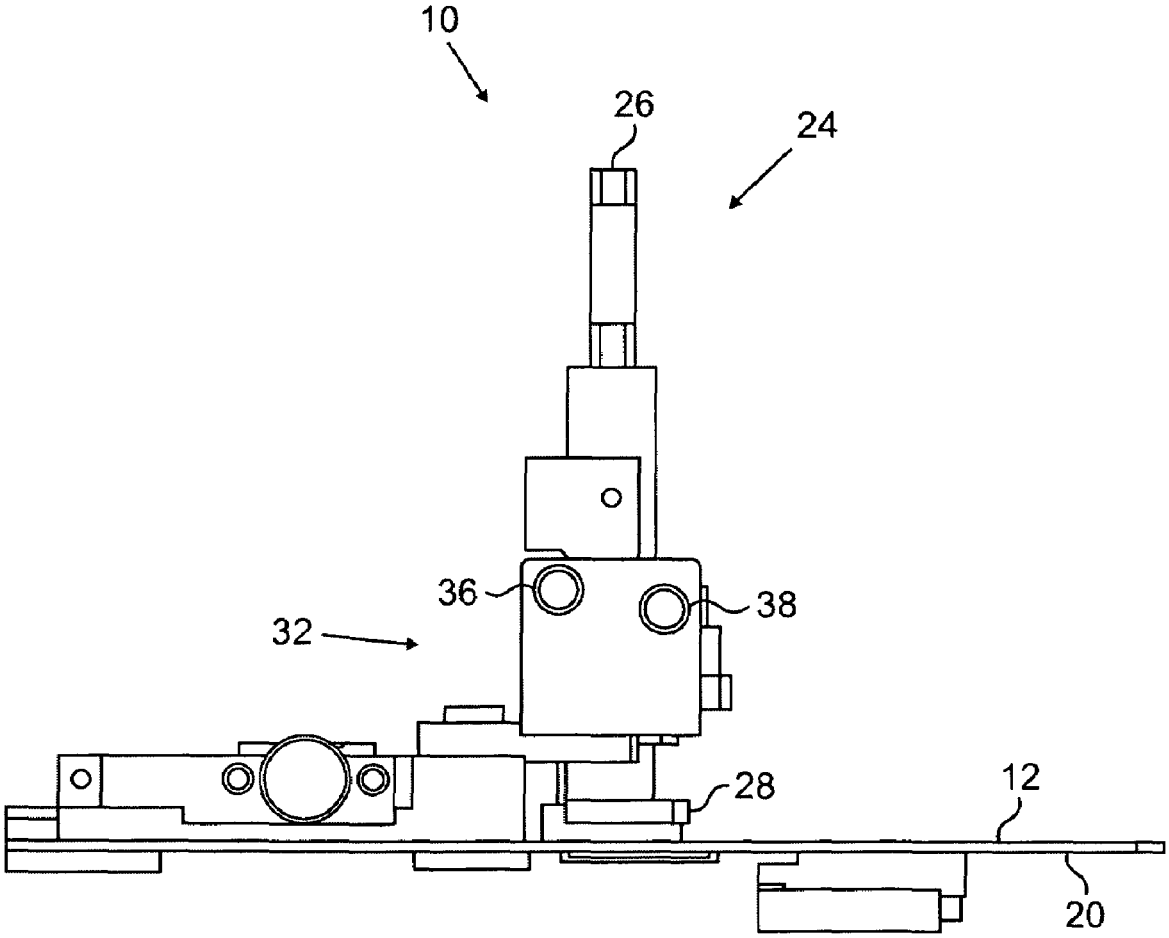
FIG. 7 is a left side view of the curved edge sewing system.

One example of a curved edge sewing system 10 according to the present invention is shown in FIGS. 1-7. FIG. 1 shows the curved edge sewing system 10 in a state to begin sewing a curved fly 12, particularly, an edge 14 of the curved fly 12. The edge 14 of the curved fly 12 which is sewn by the curved edge sewing system 10 includes a curved edge 16 and a straight edge 18. Sewing of the edge 14 of the curved fly 12 is also called serging the edge of the fly 12. The curved edge sewing system 10 is described in an embodiment of sewing the curved fly 12. However, the curved edge sewing system 10 can be used with cloths other than the curved fly 12. FIG. 2 shows the curved edge sewing system 10 during sewing of the curved fly 12 with the curved fly 12 rotated about 45°. FIG. 3 shows the curved edge sewing system 10 during sewing of the curved fly 12 with the curved fly 12 rotated about 90°. FIG. 4 shows the curved edge sewing system 10 during sewing of the straight edge 18 of the curved fly 12. FIG. 5 shows a top view of the curved edge sewing system 10 with the curved fly 12 in various rotated positions. FIG. 6 shows a front view of the curved edge sewing system 10, and FIG. 7 shows a left side view of the curved edge sewing system 10.

Referring to FIG. 1, the curved edge sewing system 10 has a cloth support table 20 for supporting the curved fly 12 during sewing. A sewing needle 22 is located at a sewing position relative to the cloth support table 20. A sewing needle drive mechanism (not shown) is linked to the sewing needle 22 and operates the sewing needle 22 to sew.

The curved edge sewing system 10 has a cloth presser device 24. A driver 26 is operatively connected to the cloth presser device 24, and the cloth presser device 24 is movable towards and away from the cloth support table 20 by the driver 26. One driver 26 suitable for use in the curved edge sewing system 10 is a linear air cylinder. However, any other suitable driver can be used to move the cloth presser device 24. The cloth presser device 24 has a gripper foot 28 at its lower end. The gripper foot 28 contacts and presses the curved fly 12 against the cloth support table 20 when the driver 26 moves the cloth presser device 24 downward (see arrow 30) towards the cloth support table 20. A controller (not shown) is connected to the driver 26 and has signals which are supplied to the driver 26 to actuate the driver 26. One controller signal actuates the driver 26 to move the cloth presser device 24 downward (see the arrow 30) to press and hold the curved fly 12 against the cloth support table 20. Another controller signal actuates the driver 26 to move the cloth presser device 24 upward away from the curved fly 12 and the cloth support table 20 (opposite the arrow 30).

The cloth presser device 24 is also rotatable about its vertical axis. Another driver 32 is operatively connected to the cloth presser device 24. The driver 32 rotates the cloth presser device 24 in a counterclockwise direction (see arrow 34) about the vertical axis and in a clockwise direction (opposite the arrow 34) about the vertical axis. Also, the driver 32 rotates the cloth presser device 24 relative to the sewing needle 22. One driver 32 suitable for use with the curved edge sewing system 10 is a pair of linear air cylinders 36, 38. However, any other suitable driver can be used to rotate the cloth presser device 24. The linear air cylinder 36 has a linearly slidable arm 40 linked to the cloth presser device 24 by a flexible cord (not shown). Referring to FIGS. 5 and 6, a connection member 42 of the arm 40 is connected to the flexible cord (not shown) which extends in an axial direction of the arm 40 towards a drum 44 of the cloth presser device 24. The flexible cord wraps around about one-half of the drum 44 and is connected to the drum 44 at a point 46. Similarly, the linear air cylinder 38 has linearly slidable arm 48 linked to the cloth presser device 24 by another flexible cord (not shown). A connection member 50 of the arm 48 is connected to the other flexible cord (not shown) which extends in an axial direction of the arm 48 towards the drum 44 of the cloth presser device 24 and wraps around about one-half of the drum 44. The second flexible cord is connected to the drum 44 at a point about 180° opposite the point 46.

The controller is connected to the driver 32 and has signals which are supplied to the driver 32 to actuate the driver 32. One controller signal actuates the driver 32 to rotate the cloth presser device 24 in the counterclockwise direction (see the arrow 34). More specifically, the controller signal actuates the linear air cylinder 36 and slides the arm 40 in the direction of the arrow 52. The sliding arm 40 pulls the flexible cord (not shown) connected to the point 46 of the drum 44 and rotates the drum 44 in the counterclockwise direction as the flexible cord is partially unwound from the drum 44. The controller signal also actuates the linear air cylinder 38 and slides the arm 48 in the direction of the arrow 54 which allows its flexible cord to be further wound onto the drum 44. Another controller signal actuates the driver 32 to rotate the cloth presser device 24 in the clockwise (opposite the arrow 34).

More specifically, this controller signal actuates the linear air cylinder 38 and slides the arm 48 in the opposite direction of the arrow 54. The sliding arm 48 pulls the flexible cord (not shown) connected to the drum 44 and rotates the drum 44 in the clockwise direction (opposite the arrow 34) as the flexible cord is partially unwound from the drum 44. The second controller signal also actuates the linear air cylinder 36 and slides the arm 40 in the opposite direction of the arrow 52 which allows its flexible cord to be further wound onto the drum 44.

Operation of the curved edge sewing system 10 will now be described in further detail. FIG. 1 shows the curved edge sewing system 10 in a state to begin a sewing operation. Initially, the cloth presser device 24 is in its upward position away from the cloth support table 20 and disengaged from the curved fly 12. The cloth presser device 24 is in a specified rotational position to begin the sewing operation. The cloth presser device 24 is now in its starting position to begin the sewing operation.

The curved fly 12 is placed on the cloth support table 20 in the position shown. The curved edge sewing system 10 may have one or more fly position locators to provide a starting position for the curved fly 12. The fly position locator may be, for example, a stop, raised wall, projection or other position indicator on the cloth support table 20. A starting point (see point 56) of the curved edge 16 of the curved fly 12 is positioned adjacent the sewing needle 22 to begin the sewing operation.

The controller provides a signal to the driver 26 which actuates the driver 26 and moves the cloth presser device 24 downward. The cloth presser device 24 is moved downward such that the gripper foot 28 contacts the curved fly 12 and presses the curved fly 12 against the cloth support table 20. The gripper foot 28 has a fly contact surface which securely engages the curved fly 12 without damaging the fly 12. The fly contact surface of the gripper foot 28 can be made of rubber, for example. Another fly contact surface of the gripper foot 28 may be a non-smooth contact surface, such as a surface having projections, for example, to securely grip the curved fly 12. The amount of pressure applied by the cloth presser device 24 to the curved fly 12 can be regulated or adjusted to provide effective gripping and rotation of the curved fly 12 without damaging the curved fly 12. The pressure applied by the cloth presser device 24 can be regulated or adjusted by regulating the amount of force applied by the driver 32, for example. Also, the gripper foot 28 may be spring-loaded in the vertical direction which can provide increased consistency in the pressure applied to the curved fly 12. The sewing operation is started and the sewing needle 22 begins to sew the curved edge 16 of the curved fly 12 at a point 56.

Referring to FIG. 2, the controller provides a signal to the driver 32 which actuates the driver 32 and rotates the cloth presser device 24. The arm 40 of the linear air cylinder 36 of the driver 32 moves in the direction of the arrow 52 and the arm 48 of the linear air cylinder 38 of the driver 32 moves in the direction of the arrow 54. As discussed above, the driver 32 rotates the cloth presser device 24 in the counterclockwise direction as shown by the arrow 34. Because the cloth presser device 24 is engaged with the curved fly 12, the rotation of the cloth presser device 24 also rotates the curved fly 12 in the counterclockwise direction as shown by the arrow 58. The cloth presser device 24 and the curved fly 12 are rotated at a desired rate based on the controller signal and the sewing needle 22 sews the curved edge 16 of the curved fly 12 as the curved fly 12 rotates. FIG. 2 shows the curved fly 12 rotated about 45° during the sewing operation.

The cloth presser device 24 continues to rotate clockwise in the direction of the arrow 34 and the curved fly 12 continues to rotate clockwise in the direction of the arrow 58 as the curved edge 16 of the curved fly 12 is sewn until the curved fly 12 reaches the position shown in FIG. 3. The controller provides a signal to the driver 32 which stops the driver 32 from rotating the cloth presser device 24. FIG. 3 shows the curved fly 12 rotated about 90° relative to the starting position of the curved fly 12 shown in FIG. 1. In the position of the curved fly 12 shown in FIG. 3, the curved edge 16 of the curved fly 12 has been sewn and the straight edge 18 of the curved fly 12 is about to be sewn.

The controller provides a signal to the driver 26 which actuates the driver 26 and moves the cloth presser device 24 upward out of pressing contact with the curved fly 12 and away from the cloth support table 20.

The cloth feeding mechanism of the curved edge sewing system 10 now feeds the curved fly 12 linearly passed the sewing needle 22 in the direction of the arrow 60 to sew the straight edge 18 of the curved fly 12 as shown in FIG. 4.

The controller provides a signal to the driver 32 which actuates the driver 32 and rotates the cloth presser device 24 in the clockwise direction (opposite of the arrow 34) to return the cloth presser device 24 to its starting position. The arm 48 of the linear air cylinder 38 of the driver 32 moves in the opposite direction of the arrow 54 and the arm 40 of the linear air cylinder 36 of the driver 32 moves in the opposite direction of the arrow 52. As discussed above, the driver 32 rotates the cloth presser device 24 in the clockwise direction (opposite the arrow 34). The curved edge sewing system 10 is ready for sewing another curved fly 12.

The curved fly 12 has been shown with a rounded corner having the curved edge 16. However, the curved edge 16 may be cut from a rectangular fly cloth piece having a square corner. The curved edge sewing system 10 may include a cutter to cut the square corner of the fly cloth piece to form the rounded corner, i.e., the curved edge 16. The cutter may be positioned adjacent the sewing needle 22 such that the curved edge 16 (rounded corner) is cut immediately upstream of the sewing needle 22. Accordingly, the fly cloth piece is cut to form the curved edge 16 and the curved edge 16 is sewn as the cloth presser device 24 rotates the fly 12 (FIGS. 1-3). One example of such a cutter is shown in U.S. patent application Ser. No. 11/482,457.

Figure 8:
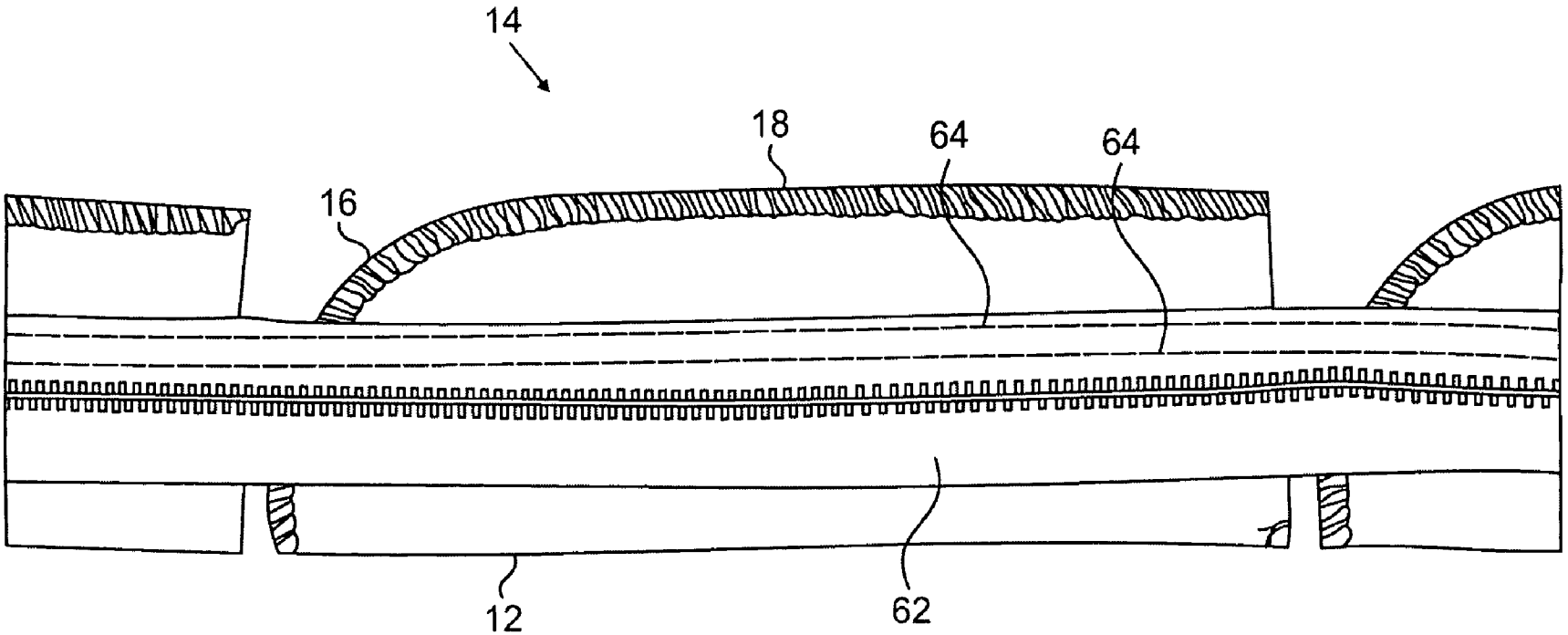
FIG. 8 shows a sewed curved fly having a sewed edge and a zipper.

The curved edge sewing system 10 has been described in terms of sewing the curved fly 12, particularly the curved edge 16 and the straight edge 18 of the fly 12. However, the curved edge sewing system 10 may include other operations, as well. For example, the curved edge sewing system 10 may automatically sew a zipper onto the curved fly 12 subsequent to sewing the edge 14 of the fly 12. FIG. 8 shows the curved fly 12 having the edge 14 (curved edge 16 and straight edge 18) sewn by the curved edge sewing system 10. A continuous zipper tape 62 is sewn onto the curved fly 12 at stitching lines 64. The curved edge sewing system 10 feeds the sewn curved fly 12 from the position shown in FIG. 4 in the direction of the arrow 60 to a zipper tape sewing station of the curved edge sewing system 10. The continuous zipper tape 62 is automatically fed to the zipper tape sewing station which has a sewing needle and sews the continuous zipper tape 62 to successive sewn curved flies 12. After the continuous zipper tape 62 is sewn to successive curved flies 12, the continuous zipper tape 62 can be cut by a cutter between the successive curved flies 12 to form individual curved flies 12 having a zipper tape.

The present invention can be practiced in numerous different embodiments. For example, curved edge sewing systems can be used for sewing curved edges of cloths other than the curved fly 12.

The amount of angular rotation of the cloth presser device 24 and the amount of angular rotation of the curved fly 12, or other cloth piece, can be varied as desired. The controller can store data indicative of the amount of desired angular rotation and the signal supplied to the driver 32 can rotate the cloth presser device 24 through a specified angle.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A curved edge sewing system for sewing a curved edge of a cloth, comprising:

a cloth support table;

a sewing needle located at a sewing position relative to the cloth support table;

a cloth presser device movable towards and away from the cloth support table and rotatable relative to the sewing needle, the cloth presser device comprising a gripper foot on a lower end of the cloth presser device, wherein the gripper foot has a disk-shaped cloth contact surface adapted for pressing the cloth against the cloth support table, and the gripper foot has a vertical axis through a central portion thereof that is coaxial with a vertical axis of rotation of the cloth presser device;

a first driver operatively connected to the cloth presser device and moving the cloth presser device towards and away from the cloth support table;

a second driver operatively connected to the cloth presser device and rotating the cloth presser device relative to the sewing needle; and a controller having a first signal supplied to the first driver and actuates the first driver, and the controller having a second signal supplied to the second driver and actuates the second driver.

2. The curved edge sewing system of claim 1, wherein during use the gripper foot of the cloth presser device holds the cloth against the cloth support table in response to the first signal of the controller, and the gripper foot of the cloth presser device rotates the cloth relative to the sewing needle in response to the second signal of the controller.

3. The curved edge sewing system of claim 2, wherein the second signal causes the gripper foot of the cloth presser device to rotate the cloth relative to the sewing needle through a specified angle.

4. The curved edge sewing system of claim 3, wherein the specified angle is about 90°.

5. The curved edge sewing system of claim 1, wherein the second signal causes the gripper foot of the cloth presser device to rotate through a specified angle.

6. The curved edge sewing system of claim 5, wherein the specified angle is about 90°.

7. The curved edge sewing system of claim 1, wherein the second driver comprises a linear air cylinder.

8. A device for positioning a cloth article to be sewed during sewing, comprising:

a cloth article holder;

a first driver operatively connected to the cloth article holder and moving the cloth article holder into and out of a cloth article holding position;

a second driver operatively connected to the cloth article holder and rotating the cloth article holder when the cloth article holder is in the cloth article holding position, the second driver comprising at least one linear air cylinder; and a controller having a first signal supplied to the first driver and actuates the first driver, and the controller having a second signal supplied to the second driver and actuates the second driver, wherein:

the linear air cylinder comprises at least one linearly slidable arm, and the linearly slidable arm is linked to the cloth article holder by a flexible cord, and when the linear air cylinder is actuated to pull the linearly slidable arm in a direction away from the cloth article holder, the linearly slidable arm pulls the flexible cord in a direction away from the cloth article holder and the cloth article holder is rotated about its vertical axis.

9. The device for positioning a cloth article to be sewed during sewing of claim 8, wherein during use the cloth article holder rotates the cloth article to be sewed in response to the second signal of the controller.

10. The device for positioning a cloth article to be sewed during sewing of claim 9, wherein the second signal causes the cloth article holder to rotate the cloth article to be sewed through a specified angle.

11. The device for positioning a cloth article to be sewed during sewing of claim 10, wherein the specified angle is about 90°.

12. The device for positioning a cloth article to be sewed during sewing of claim 8, wherein the second signal causes the cloth article holder to rotate through a specified angle.

13. The device for positioning a cloth article to be sewed during sewing of claim 12, wherein the specified angle is about 90°.

14. The device for positioning a cloth article to be sewed during sewing of claim 8 comprising a first linear air cylinder and a second linear air cylinder, the first and second linear air cylinders comprising first and second linearly slidable arms, respectively, wherein the first and second linearly slidable arms are linked to the cloth article holder by first and second flexible cords, respectively, and the first flexible cord is attached to the cloth article holder at a first location and the second flexible cord is attached to the cloth article holder at a second location, the first location and second location being located 180° from each other around a perimeter of the cloth article holder.

15. A method of sewing a curved edge of a cloth, comprising:

positioning a cloth on a support table;

pressing the cloth against the cloth table with a cloth presser device in response to a first signal from a controller, the cloth presser device comprising a gripper foot on a lower end of the cloth presser device, wherein the gripper foot has a disk-shaped cloth contact surface adapted for pressing the cloth against the support table and the gripper foot has a vertical axis through a central portion thereof that is coaxial with a vertical axis of rotation of the cloth presser device;

after pressing the cloth against the table with the cloth presser device, rotating the cloth presser device in response to a second signal from the controller, wherein the step of rotating the cloth presser device comprises actuating a linear air cylinder to pull a linearly slidable arm in a direction away from the cloth presser device, the linearly slidable arm being linked to the cloth presser device by a flexible cord, wherein the flexible cord is pulled away from the cloth presser device in response to actuating the linear air cylinder and causes the cloth presser device to rotate about its vertical axis;

rotating the cloth by the rotation of the cloth presser device; and sewing the cloth along a curved edge during the rotation of the cloth.

16. The method of sewing a curved edge of a cloth of claim 15, wherein rotating the cloth presser device and rotating the cloth comprise rotating the cloth through a specified angle.

17. The method of sewing a curved edge of a cloth of claim 16, wherein the specified angle is about 90°.

* * * * *